US005943828A

United States Patent [19]

Samborn et al.

[11] Patent Number: 5,943,828

[45] Date of Patent: Aug. 31, 1999

[54] DISPLAY ASSEMBLY

[75] Inventors: Michael R. Samborn, Atlanta; William Randolph Dudley, Jr., Lawrenceville, both of Ga.

[73] Assignee: Kraft Foods, Inc., Northfield, Ill.

[21] Appl. No.: 08/906,993

[22] Filed: Aug. 6, 1997

[51] Int. Cl.[6] ..... A47F 9/00; A47F 10/06; E04H 1/12

[52] U.S. Cl. ..... 52/36.1; 52/38; 52/105; 52/79.9; 52/243; 52/653.2; 40/617; 312/196; 312/237; 312/140.2; 312/140.4

[58] Field of Search ..... 52/36.1, 36.2, 52/38, 79.6, 105, 243, 79.5, 86, 653.1, 653.2, 79.9; 312/140.2, 140.4, 102, 114, 237, 196; 40/617; 211/189

[56] References Cited

U.S. PATENT DOCUMENTS

| | | | |
|---|---|---|---|
| 589,971 | 9/1897 | Kephart | 52/36.2 |
| 888,681 | 5/1908 | Abraham | 312/140.4 |
| 948,377 | 2/1910 | Prouty | 312/196 |
| 2,106,839 | 2/1938 | Gilbert . | |
| 2,443,871 | 6/1948 | Shield . | |
| 3,125,385 | 3/1964 | Friedman . | |
| 3,170,541 | 2/1965 | Werner . | |
| 3,908,830 | 9/1975 | Skrzelowski . | |
| 4,401,223 | 8/1983 | Spamer . | |
| 4,541,675 | 9/1985 | Everett | 211/189 X |
| 4,946,050 | 8/1990 | Akopiantz | 211/189 X |
| 5,183,319 | 2/1993 | Pearson et al. | 312/196 |
| 5,459,974 | 10/1995 | Barry et al. | 52/86 X |
| 5,607,211 | 3/1997 | Henninger . | |
| 5,692,342 | 12/1997 | Devlin | 52/36.1 |

OTHER PUBLICATIONS

U.S. Pat. App. No. 08/907,246 Samborn, et al. Filed Aug. 6, 1997, pending.

U.S. Pat. App. No. 08/905,273 Samborn, et al. Filed Aug. 6, 1997, pending.

U.S. Design Pat. App. No. 29/074,745 Samborn, et al. Filed Aug. 6, 1997, pending.

*Primary Examiner*—Robert Canfield
*Attorney, Agent, or Firm*—Fitch, Even, Tabin & Flannery

[57] ABSTRACT

A food vending area display structure for mounting on a counter top or other support surface comprising a front row of posts mounted on the support surface so as to extend upward therefrom, a plurality of display headers extending between adjacent posts in the row to identify separate dispensing areas, and a plurality of resilient transverse structural members extending between adjacent posts in the row to enable the posts to support one another in reacting to horizontal loads so that the posts need not pass through the support surface. The resilient transverse structural members may comprise curved metal grill bars having fittings at their ends which enable them to be fastened to the vertical posts by conventional hose clamps to facilitate assembly.

11 Claims, 8 Drawing Sheets

Fig. 8
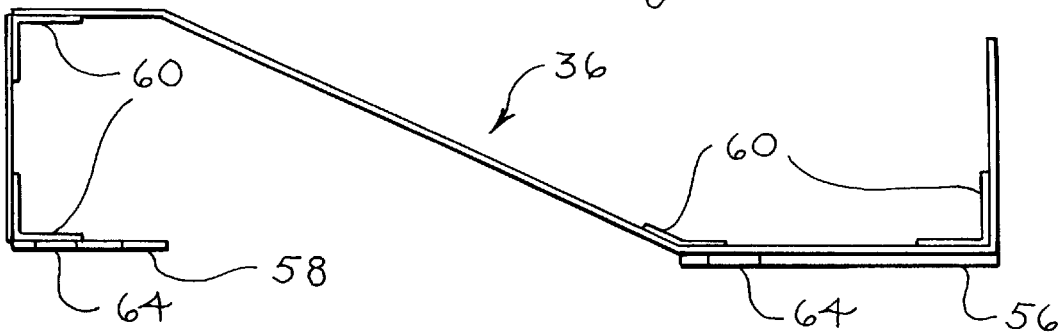
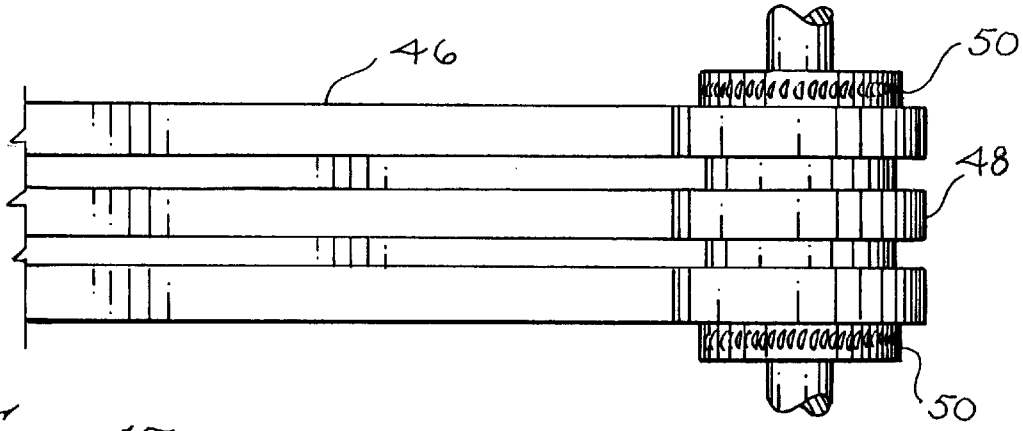
Fig. 13
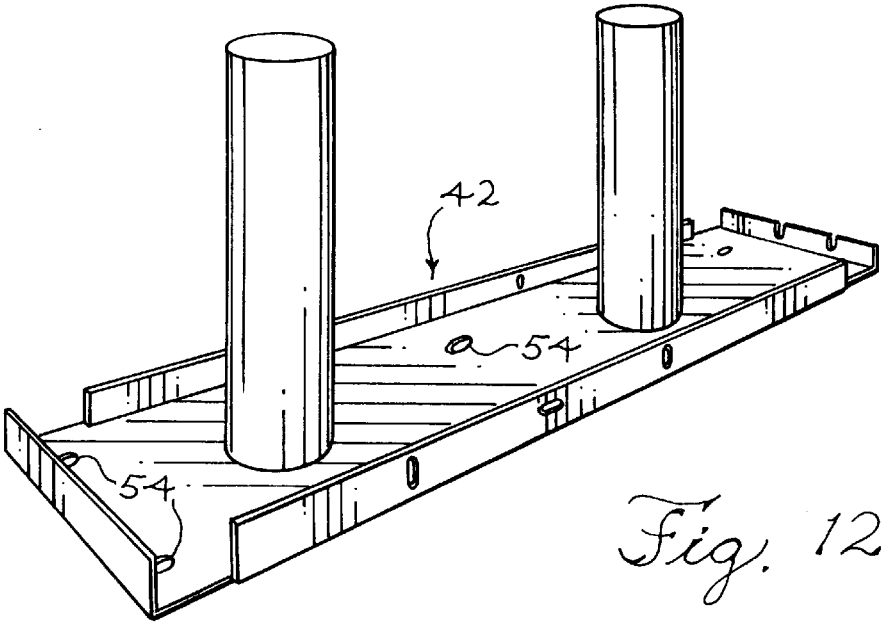
Fig. 12

DISPLAY ASSEMBLY

BACKGROUND OF THE INVENTION

1. Field of the Invention

The invention relates generally to display stands and the like, and more particularly to a display structure for a food vending area.

2. Background and Description of Related Art

In many cafeterias, convenience stores, and other food vending areas, a number of different food items are presented for purchase by consumers on counter tops or other surfaces. Signage may be suspended from a ceiling or other overhead support, or may be supported on posts extending upward from a cabinet or counter.

Suspension of signage from above requires that suitable overhead support structures be available. Overhead suspension of signage may be complicated by overhead lighting fixtures, HVAC equipment, and the like. On the other hand, where the signs are supported by posts extending upward from a counter top on a cabinet, the posts may be subject to accidental displacement or damage unless they are secured in place by a secure mounting arrangement which may involve, e.g., extending the posts entirely through the counter top and through the cabinet interior to the bottom of the cabinet, which requires a labor-intensive installation, and may conflict with other uses of the cabinet interior space.

It is a general object of the invention to provide an improved display structure for food vending areas.

SUMMARY OF THE INVENTION

In accordance with the invention, there is provided a food vending area display structure for mounting on a counter top or other support surface comprising a front row of posts mounted on the support surface so as to extend upward therefrom, a plurality of display headers extending between adjacent posts in the row to identify separate dispensing areas, and a plurality of resilient transverse structural members extending between adjacent posts in the row to enable the posts to support one another in reacting to horizontal loads so that the posts need not pass through the support surface. The resilient transverse structural members may comprise curved metal grill bars having connectors at their ends which facilitate fastening them to the vertical posts.

In the preferred embodiment, a back row of posts is also provided, with each post in the back row being connected to a respective one of the front posts in a preassembled unit to facilitate on-site assembly.

The invention provides an efficient and economical arrangement for organizing a food vending area and dividing the area into separate dispensing areas with appropriate signage for each individual dispensing area. The signs are supported at a sufficient height to enable at least the uppermost signs to be visible across a crowded room to guide consumers to desired vending areas. The structure preferably is capable of attaching to the top surface of a counter without requiring extension of structural members into the interior of a cabinet or other structure below the counter.

The invention provides a display structure which is versatile, attractive, economical, and easy to assemble. Further advantages of the invention are described below and shown in the accompanying drawings.

BRIEF DESCRIPTION OF THE DRAWINGS

FIG. 8 is a side elevational view of the header;

FIG. 12 is a perspective view of a mounting bracket of the display stand; and FIG. 13 is an enlarged detail view showing an interconnection between a grill assembly and a vertical post in the display stand.

DETAILED DESCRIPTION OF PREFERRED EMBODIMENT

Figure 1:
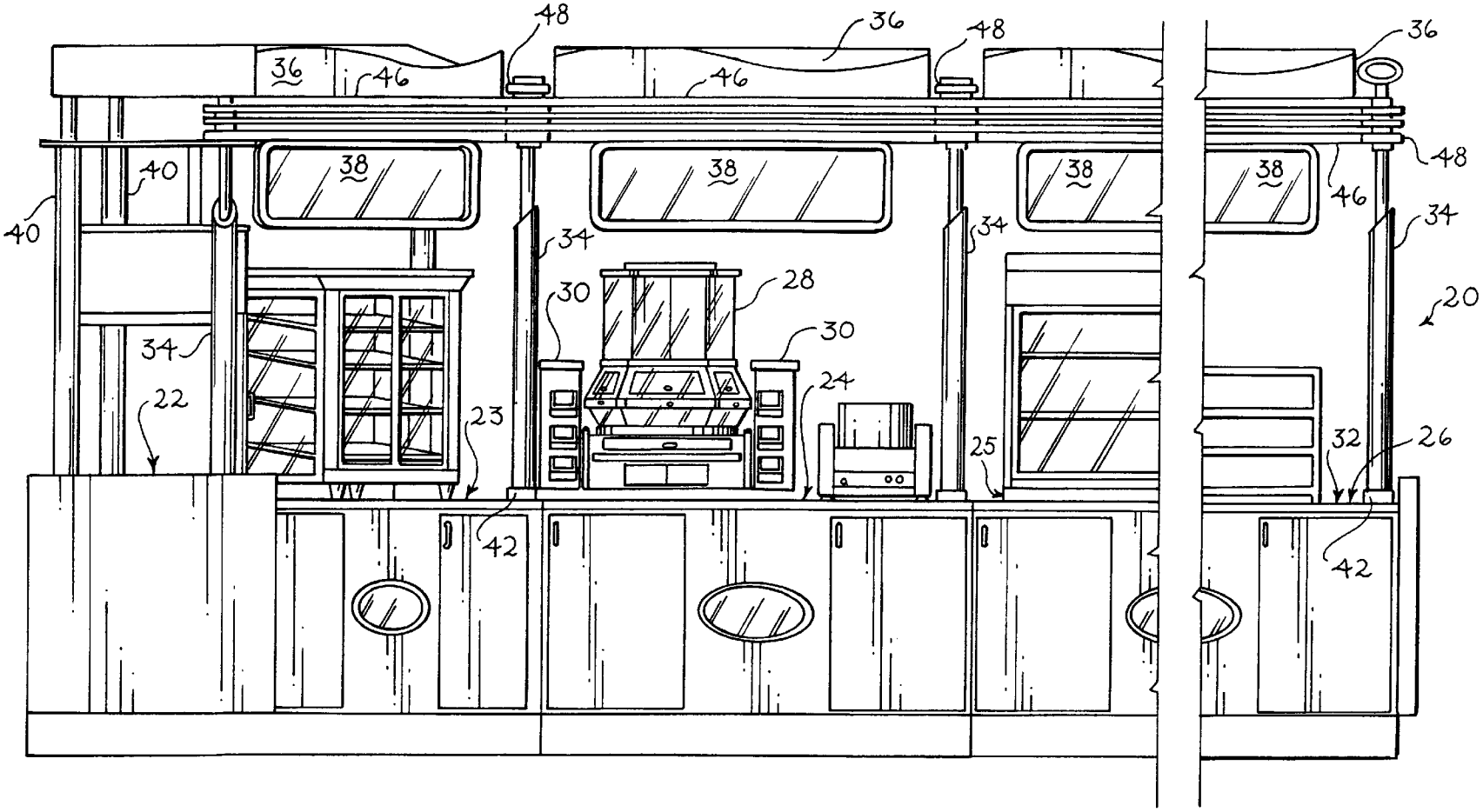
FIG. 1 is a foreshortened front elevational view of a display assembly in accordance with a preferred embodiment of the invention.

The invention is generally embodied in a display assembly 20 for dividing a food vending area into a plurality of dispensing areas 22, 23, 24, 25, and 26 which are identified by appropriate signage describing products or product categories assigned to each dispensing area. Different types of dispensing apparatus for food and beverages may be employed, as shown in FIG. 1, including, but not limited to, e.g., a bagel dispenser 28 and chilled condiment dispensers 30, along with toasters, disposable plates, utensil holders, stacks of drinking cups, and other items. The bagel dispenser and chilled condiment dispensers shown in FIG. 1 are described in detail in co-pending U.S. patent applications of Michael R. Samborn and William R. Dudley, Jr., entitled "Chilled Condiment Dispenser" and "Self-Serve Food Product Dispenser", filed on the same date as this application, on behalf of Kraft Foods, Inc., the disclosures of which are incorporated herein by reference.

As shown in FIG. 1, the display assembly preferably is positioned on a support surface such as a counter top 32 which, in the embodiment shown, is supported by a cabinet therebeneath having interior space which may contain plumbing and electrical supply lines, and/or may be used for storage of food products, plates, utensils, or other items.

The display structure preferably includes a front row of posts 34 defining a separate dispensing area between each adjacent pair of posts. Above each dispensing area is provided a header 36 which may have a general food product category such as "bakery" or "beverages" thereon. A separate sign 38 may be suspended therebelow to convey additional information, e.g., more specific product information, including prices. The lower sign 38 may be suspended from the header by conventional wires or chains, or may be otherwise supported.

To enable the signage to provide guidance to consumers from across a crowded cafeteria, convenience store, or other area, the header 36 is preferably at a height of at least about seven feet, and has its information printed thereon in letters large enough to be read from several feet away.

Figure 2:
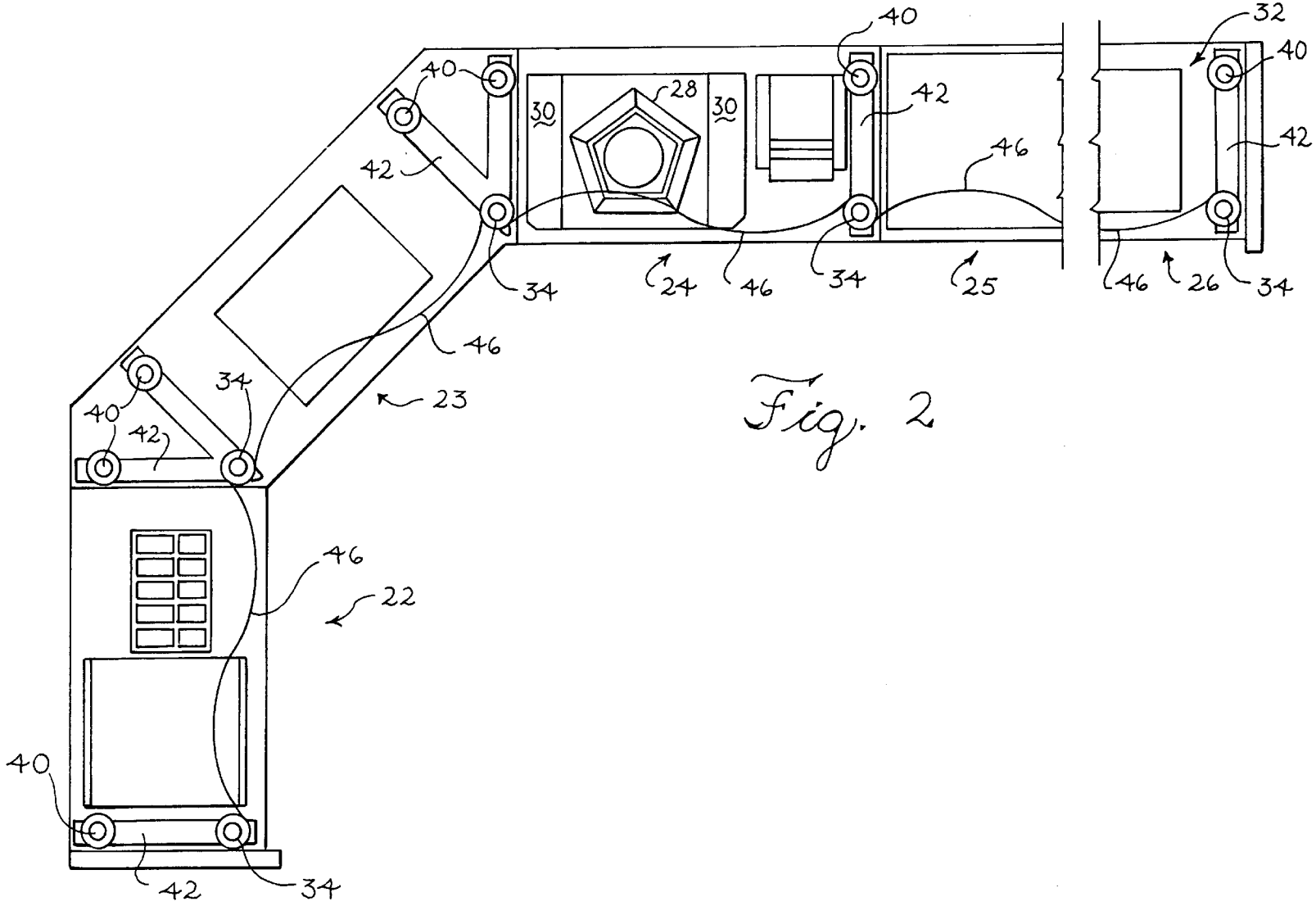
FIG. 2 is a schematic foreshortened plan view thereof.

As shown in FIG. 2, a back row of posts 40 is preferably provided behind the front row of posts 34 to add support to the assembly. Each post in the back row is associated with and connected to one or more posts in the front row by a relatively rigid mounting bracket 42 at its lower end, and by one or more struts 44 located thereabove.

One of the problems which must be addressed in connection with a display structure of this type is the possibility that the posts may be bumped by consumers or workers, or by equipment, or may otherwise be subjected to horizontal impact loads or other loads which may tend to displace or damage the posts. Insofar as the posts are not attached to a ceiling or other overhead structure, the bending moments associated with loads applied to the posts at a level significantly above the counter top may tend to be particularly problematic where it is desired to use lightweight posts and other components which may be assembled economically and efficiently without a labor-intensive assembly process requiring the posts to be secured at the bottom of the counter, or otherwise requiring extensive labor and use of multiple tools during installation.

To address this problem, in the preferred embodiment of the invention, the posts 34 in the front row are connected to one another by resilient transverse curved structural members 46 extending between adjacent posts to enable the posts to support one another in reacting to horizontal loads so that the posts 34 need not pass through the support surface 32. The preferred resilient transverse curved structural members comprise lightweight horizontal grill members made of a resilient metal material such as an aluminum material, oriented so that they will resiliently bend in response to loads urging adjacent posts in the front row toward or away from one another. Thus, the grill members have sufficient stiffness to provide the requisite strength for the structure, but are flexible enough to accommodate small displacements. The illustrated grill members each comprise three relatively thin bands of material extending generally horizontally, vertically spaced from one another and substantially parallel to one another.

Each of the grill members 46 has at each end a generally semi-circular connector member 48 adapted for complementary engagement with a corresponding opposite connector member 48 from an adjacent grill member, for connection to one of the vertical posts 34. Each of the grill members has, at its opposite ends, oppositely oriented curved portions which wrap around the connector members 48 at the ends thereof. Between the connector members, each grill member has a curvature which may be described as a wave-shaped curve, or an S-curve, comprising two oppositely oriented portions, each having a relatively large radius of curvature.

The complementary connector members 48 have interior recesses 52 for engaging the upstanding posts 34. As shown in FIG. 13, conventional hose clamps 50 may be employed at the upper and lower end of each pair of connectors to clamp them securely onto an associated post, combining the connectors into a generally cylindrical configuration.

Each of the posts 34 and 40 may comprise a lightweight, tubular inner structural post, and a lightweight, tubular outer decorative post extending coaxially over at least a portion of the exterior thereof.

In the illustrated embodiment, each post 34 in the front row is preassembled with one or more associated posts 40 in the back row to facilitate on-site assembly of the structure. The associated front and back posts 34 and 40 are connected at their lower ends by a mounting bracket 42, shown in detail in FIG. 12, which may readily be fastened to a counter top 32 or other support surface through the use of screws placed through predrilled holes 54 in the bracket. Covers may be placed over the brackets for aesthetic purposes. Each of the mounting brackets 42 has a pair of generally cylindrical inserts extending upward therefrom for insertion into the hollow lower ends of the associated posts 34 and 40. Additional rigidity for the structure is provided by the struts 44 connecting the front and rear posts near their upper ends, extending generally horizontally between the back and front posts, which are preassembled therewith.

Figure 7:
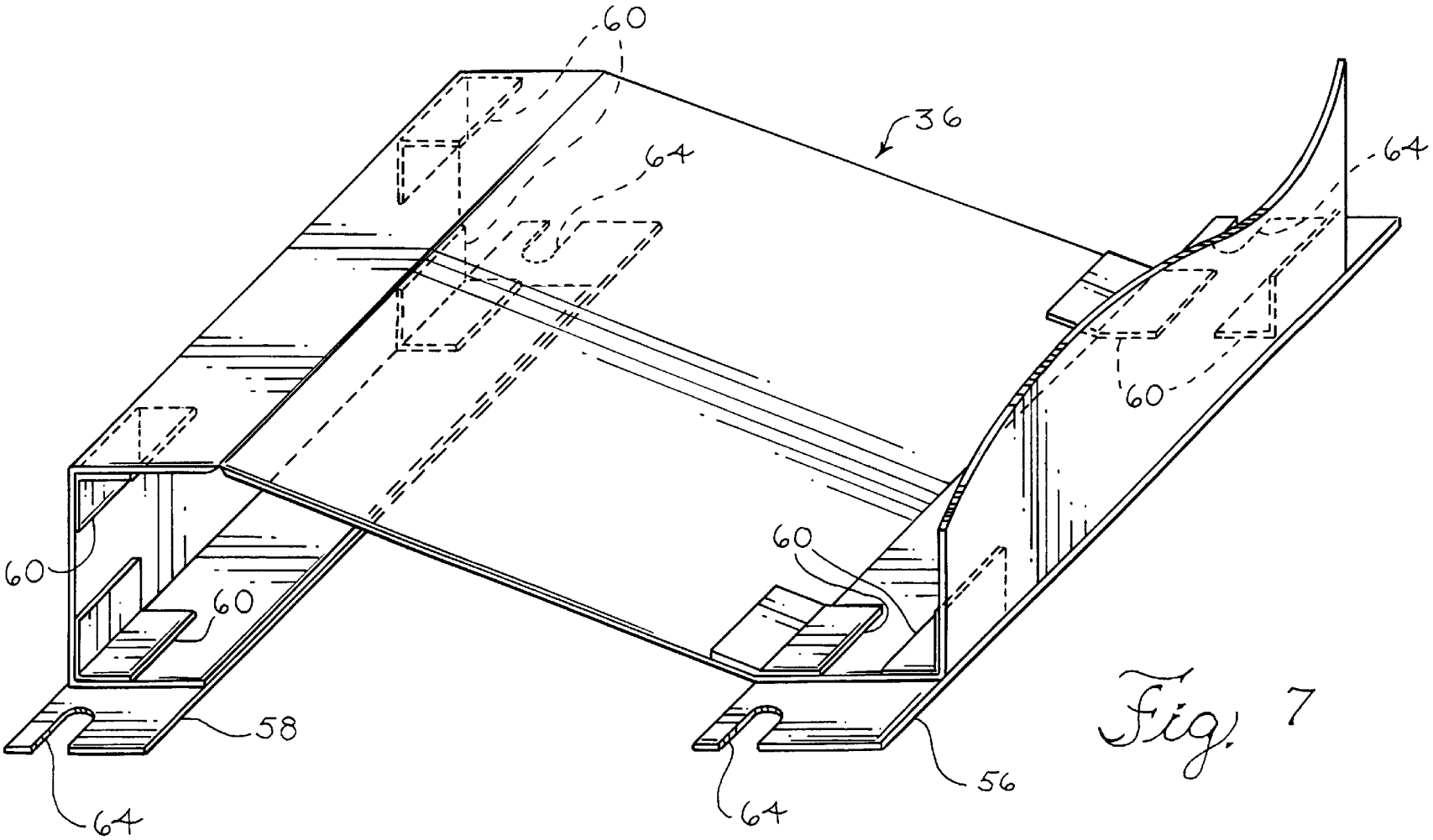
FIG. 7 is an enlarged perspective view of a header of the display stand of FIG. 1.
Figure 9:
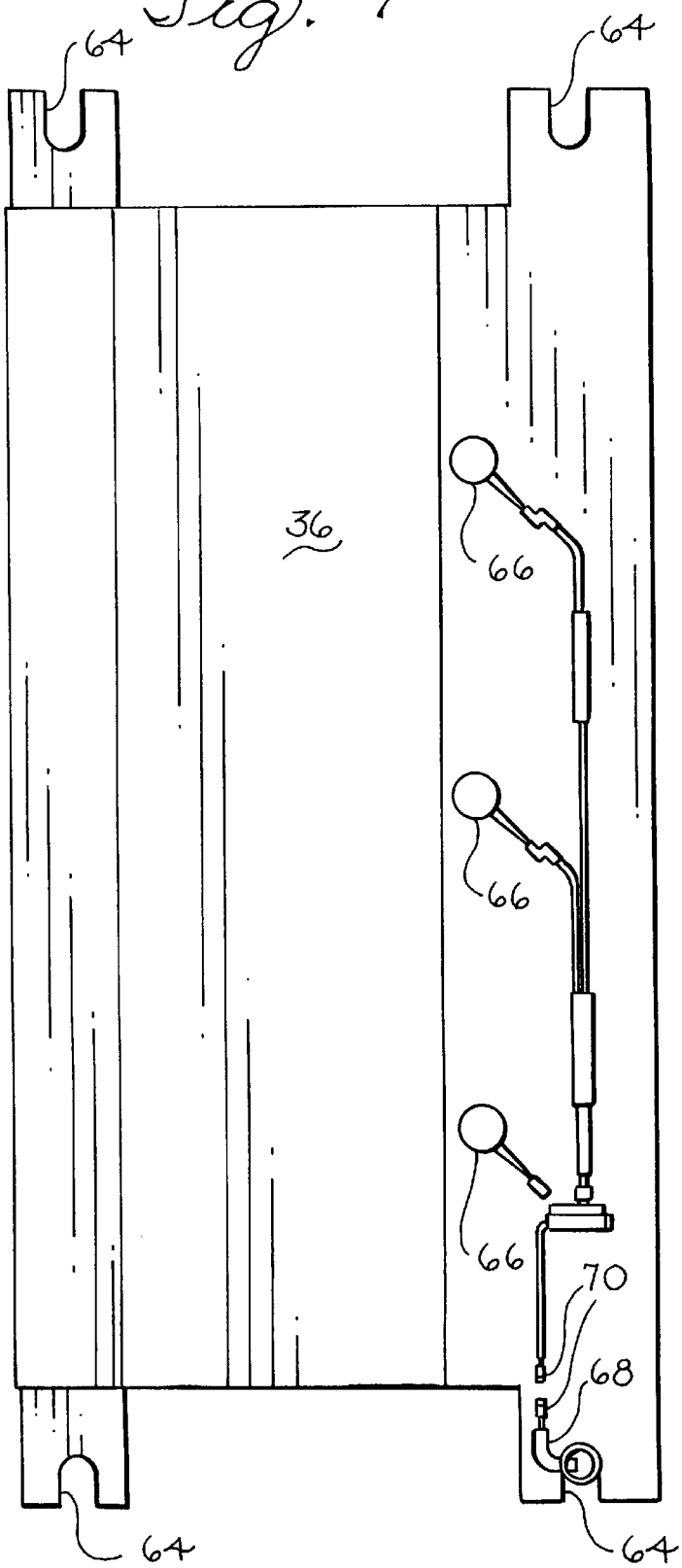
FIG. 9 is a plan view of the header.
Figure 10:
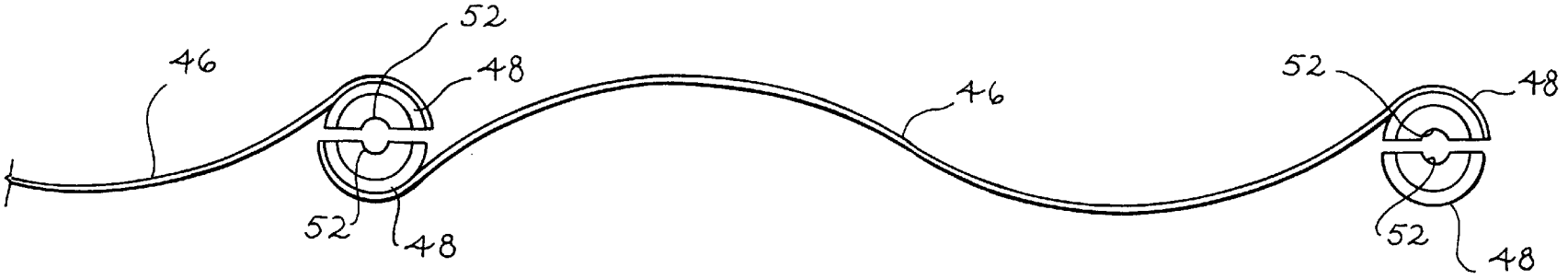
FIG. 10 is an exploded plan view of adjacent grill assemblies of the display stand in a linear assembly.
Figure 11:
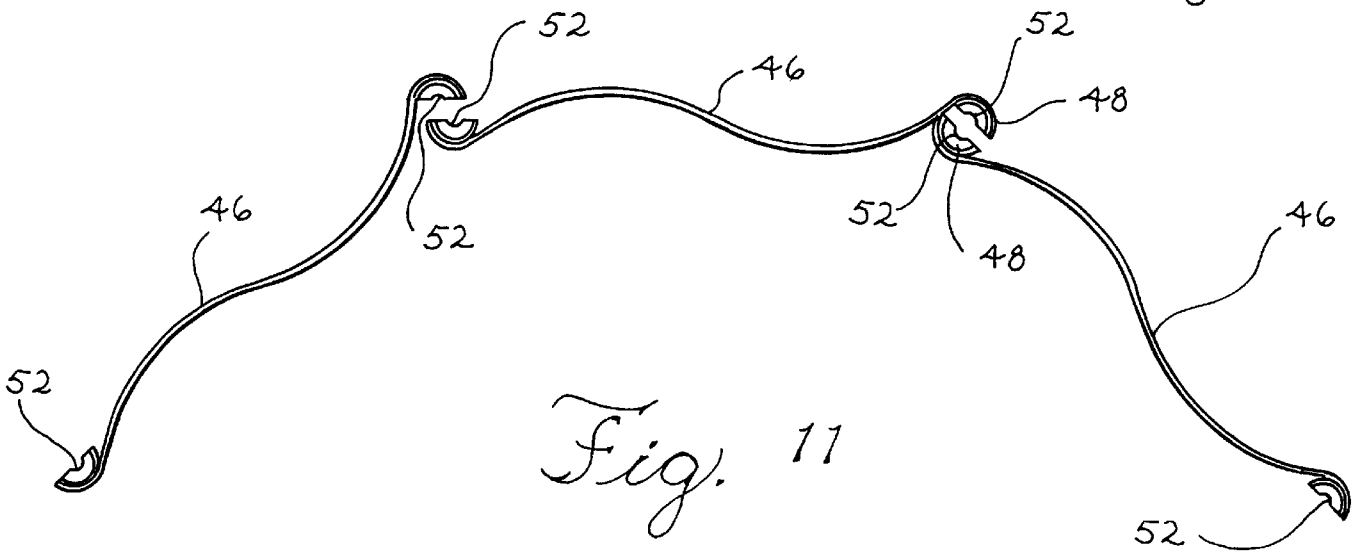
FIG. 11 is an exploded plan view of grill assemblies extending around a corner.

As shown in FIGS. 7, 8, and 9, each display header 36 generally comprises a relatively thin, folded sheet of a relatively stiff material, supplemented by front and rear support plates 56 and 58, respectively, and corner reinforcements 60. In one particular embodiment, a composite aluminum material is employed for construction of the header. It will be appreciated that other materials may be employed in other embodiments.

To facilitate assembly of the headers with the posts, the headers rest, at their forward ends, on the connectors at the upper ends of the posts, and at their rear ends, on annular supports 62 on the rear posts, with outwardly opening, generally U-shaped slots 64 being provided at opposite sides of both front and rear horizontal support surfaces on the headers. Each header thus may be installed on its associated posts without the use of tools, and without requiring precise alignment of the posts relative to the header, by tilting the header and engaging slots on first one side, then the other, with the posts.

Figure 3:
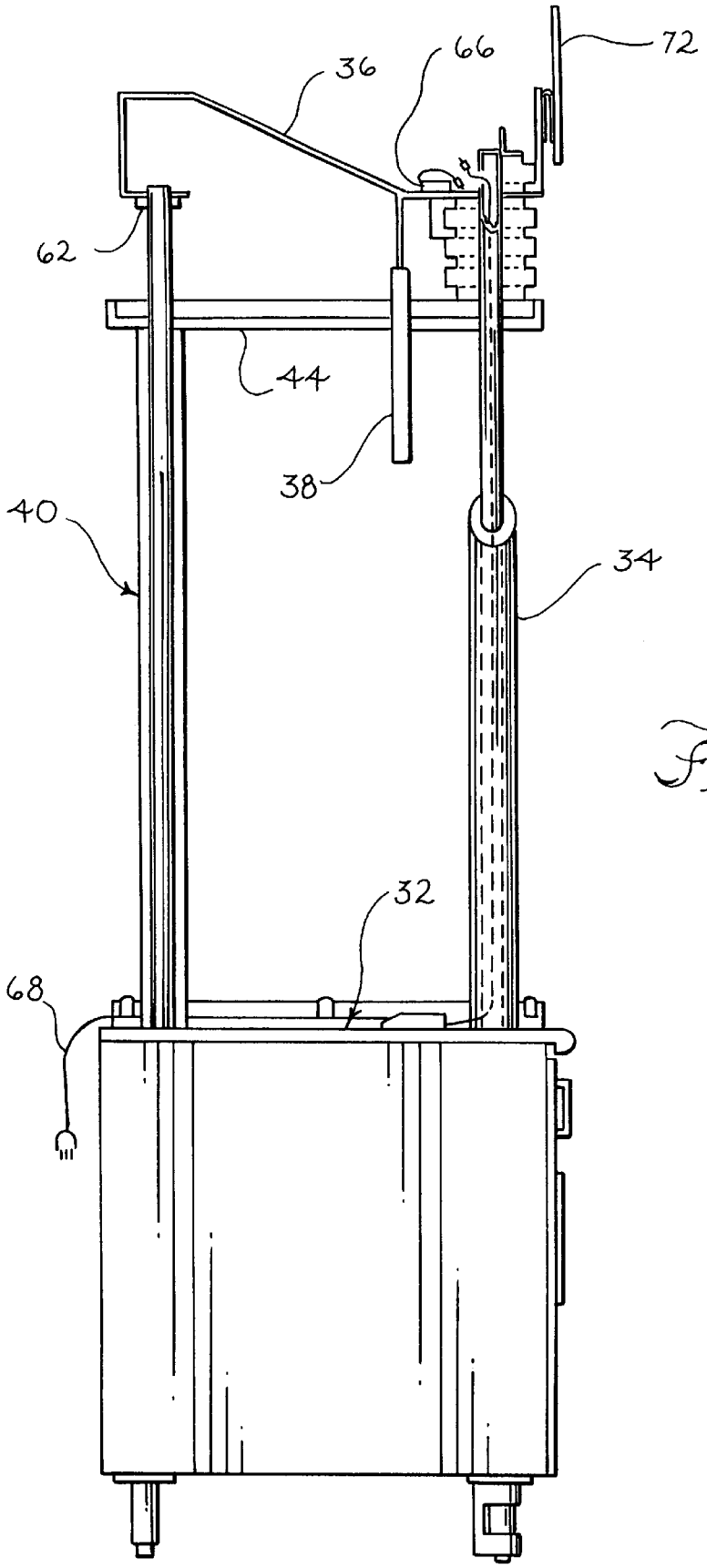
FIG. 3 is an enlarged view illustrating portions of the display stand of FIG. 1.
Figure 4:
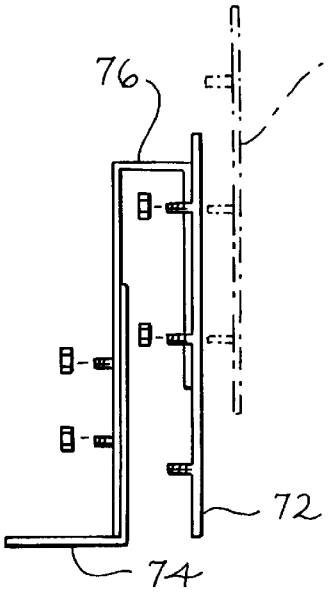
FIG. 4 is an exploded side elevational view of a component of the display stand.
Figure 5:
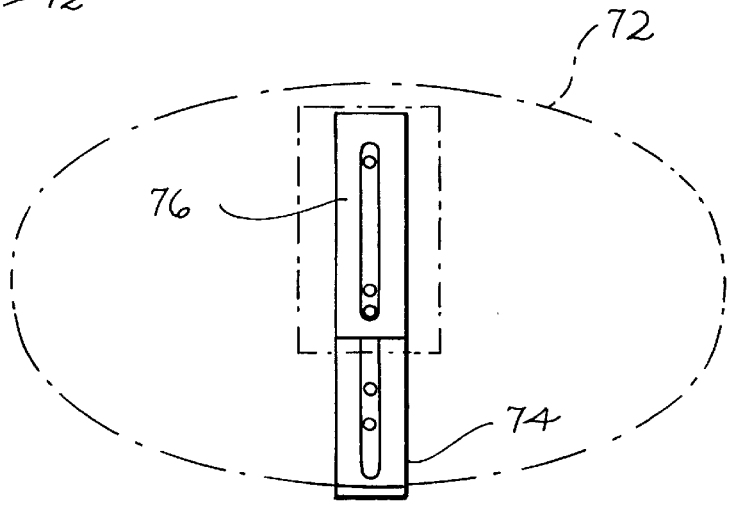
FIG. 5 is a front elevational view of the component of FIG. 4.
Figure 6:
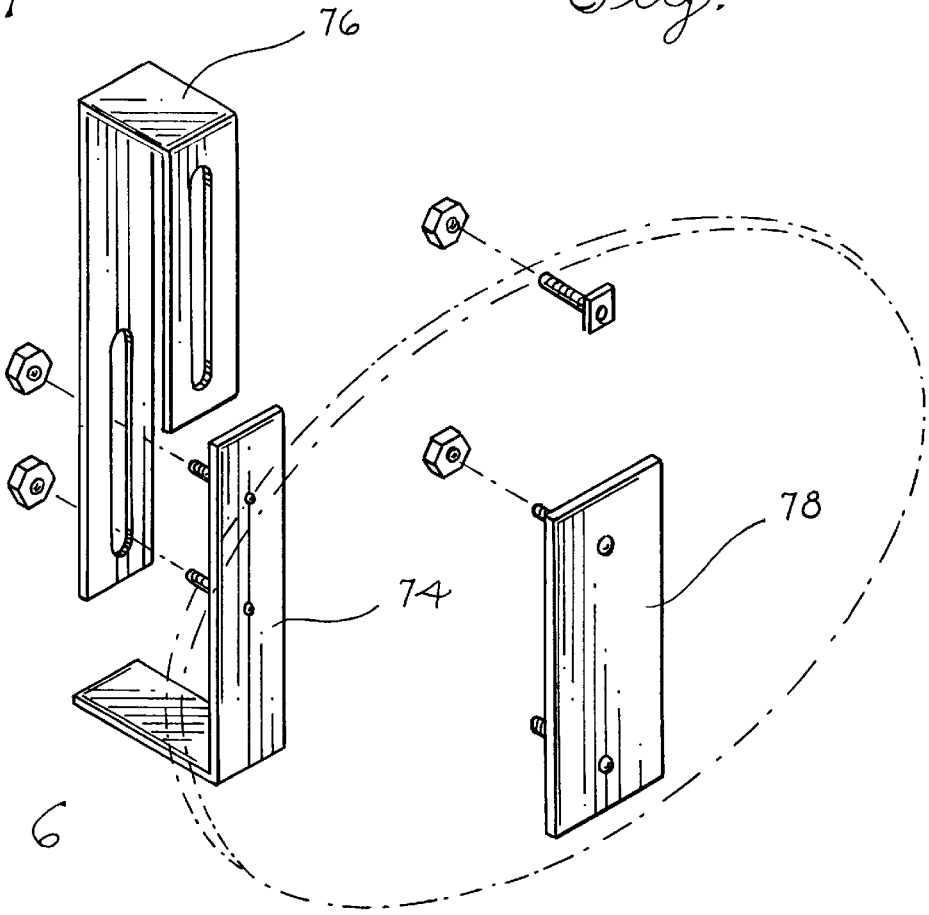
FIG. 6 is an exploded perspective view of the component of FIG. 4.

As shown in FIGS. 3 and 9, the headers preferably have preassembled lighting fixtures 66 installed thereon to illuminate the dispensing area beneath the header, and the vertical posts have preinstalled wiring 68 therein to provide power to the lighting. Complementary connectors 70 are provided on the header and post to facilitate the necessary electrical connections.

In some applications, it may be desirable to provide one or more signs above the height of the headers to display such information as the manufacturer or distributor of a food to be dispensed in the display stand. However, due to variable clearances with respect to overhead lighting or other structures, preinstalled signage of this type may present installation problems at some locations. To address this problem, a vertically adjustable sign 72 may be provided as shown in FIGS. 3 through 6. The vertically adjustable sign 72 is supported on a three-piece bracket comprising a first, L-shaped member 74 which is affixed to the header, a second, intermediate member 76 having a first vertical slot therein for engagement with the L-shaped member 74, and a second vertical slot therein for engagement with a third bracket member 78 which is affixed to the sign 72. In the illustrated embodiment, both the first, L-shaped member, and the third member have studs thereon for connection to the intermediate member. In other embodiments, different vertically-adjustable brackets may be employed.

In one particular embodiment, the display structure can be installed on a counter top and assembled without any tools other than a screwdriver, with the possible exception of a drill being required to drill holes in the counter top for the screws that secure the mounting brackets in place. The display structure may extend linearly along a counter top, or may extend around one or more corners, as shown, e.g., in FIG. 2. The display assembly thus is versatile, easy to assemble, as well as providing an attractive, commercially practical and economical assembly suitable for use in cafeterias, convenience stores, and other food vending locations. The term "food" is used broadly in the instant application to refer collectively to solid food items as well as to beverages.

From the foregoing, it should be appreciated that the invention provides a novel and improved display arrangement for use in food vending areas and the like. The invention is not limited to the embodiment described herein, nor to any particular embodiment, but rather is described and pointed out in the following claims.

What is claimed is:

1. A food vending area display structure comprising:

a support surface;

a front row of posts mounted on said support surface so as to extend upward therefrom;

a plurality of display headers extending between adjacent posts in said row to identify separate dispensing areas; and a plurality of resilient transverse curved structural members extending between adjacent posts in said row to enable said posts to support one another in reacting to horizontal loads so that said posts need not pass through said support surface.

2. A food vending area display structure in accordance with claim 1 further comprising a back row of posts mounted on said support surface and extending upward therefrom, each post in said back row being connected to a respective one of the posts in said front row by a structural member.

3. A display stand comprising:

(a) at least two vertical post assemblies, said vertical post assemblies being spaced apart in a parallel, side-by-side manner, and each of said vertical post assemblies having at least one front post being spaced apart in a parallel, front-back manner from at least one back post, and said front and said back vertical posts each having a lower section attached to a flat base which connects said vertical posts, each of said front and said back vertical posts having an upper section, and at least one of said front and said back vertical posts having space within its lower section for the insertion therein of a mounting assembly;

(b) at least two cylindrically-shaped clamping units, each of said clamping units having a front section and a rear section, and with at least one of said clamping units being attached to said upper section of each of said front vertical posts;

(c) at least one grill bar, said grill bar being resilient, and said grill bar having a shape such that one end of said grill bar can attach to the front section of one of said clamping units and the other end of said grill bar can attach to the rear section of another of said clamping units;

(d) at least one header, said header having a front section and a rear section, said front section being positioned on top of said grill bar, and said front section generally describing a food item to be dispensed in said display stand, and said rear section being positioned on top of said back vertical posts; and (e) at least one menu board, said menu board being positioned below said grill bar and above a food item to be dispensed in said display stand, and said menu board being removably attached to said header;

said display stand having space for the placement therein of one or more food dispensers, said display stand being removably attachable to a flat surface without placing any of said posts through said flat surface, and said display stand only requiring said flat surface for support.

4. The display stand of claim 3 wherein said display stand additionally comprises at least one structure which describes the manufacturer or distributor of a food to be dispensed in said display stand, said structure being positioned above said header.

5. The display stand of claim 3 wherein said header has at least one light for illuminating a food and/or beverage to be dispensed in said display stand.

6. The display stand of claim 3 wherein each of said posts has surfaces thereon for supporting said headers, and each of said headers has outwardly opening slots for engagement with said posts, so that said headers may be installed on said posts and supported on said posts without the use of tools.

7. A kit for assembly of a food vending area display structure comprising:

a plurality of post assemblies, each post assembly comprising a front post, a rear post, a mounting bracket joining said front post and said rear post near their lower ends, and a strut extending between said front post and said rear post near their upper ends; and a plurality of headers, each header having a front display sign area providing product information;

each header having outwardly opening slots for engaging said posts near the upper ends thereof so that said headers are supported on said posts near their upper ends; and resilient transverse structural members having connectors at their opposite ends for connection to adjacent posts so that some of said posts may be structurally connected to one another.

8. A kit in accordance with claim 7 further comprising light fixtures and associated wiring installed on one or more of said headers and wiring preinstalled on one or more of said posts, and means for connecting the wiring on one or more of said posts with wiring on one or more of said headers to provide electrical power to the lighting fixtures on one or more of said headers.

9. A kit in accordance with claim 8 further comprising a vertically adjustable sign and means for attaching said vertically adjustable sign to one of said headers so that said sign may be displayed at an elevation above said one of said headers at any height within a predetermined range.

10. A kit in accordance with claim 7 wherein said kit is capable of installation on a counter top simply by drilling holes into said counter top and subsequently screwing said mounting brackets to said counter top, and assembling the components of the kit, wherein assembly of the components does not require the use of any tools other than a screwdriver.

11. A kit in accordance with claim 10 further comprising at least one lower sign for display beneath one of said headers, and means for suspending said lower sign from said header.

* * * * *